United States Patent [19]

Weck, III

[11] 4,129,326

[45] Dec. 12, 1978

[54] CARPET LIFTING METHOD AND APPARATUS

[76] Inventor: Frederick Weck, III, 316 Chestnut Dr., Lanoka Harbor, N.J. 08734

[21] Appl. No.: 831,375

[22] Filed: Sep. 8, 1977

[51] Int. Cl.[2] ..... E04F 21/20

[52] U.S. Cl. ..... 294/8.6

[58] Field of Search ..... 294/8.6; 248/431, 287, 248/301, 305; 214/45 T

[56] References Cited

U.S. PATENT DOCUMENTS

| | | | |
|---|---|---|---|
| 303,510 | 8/1884 | Harkness | 294/8.6 |
| 755,960 | 3/1904 | Strader | 294/8.6 |

*Primary Examiner*—James B. Marbert

*Attorney, Agent, or Firm*—Robert K. Youtie

[57] ABSTRACT

A carpet lifting method and apparatus wherein a hook type fastener fabric, say of the kind generally referred to by the trademark "Velcro," is placed in adhering engagement with a carpet, and the fabric is raised to simultaneously lift the carpet, after which the carpet may be stripped from the fastener fabric.

6 Claims, 5 Drawing Figures

CARPET LIFTING METHOD AND APPARATUS

BACKGROUND OF THE INVENTION

Heretofore in raising or removing laid carpet, it was necessary to employ a variety of pulling and scraping implements, which required the expenditure of considerable effort and time, and often resulted in damage to either or both the removed carpet and nether floor.

SUMMARY OF THE INVENTION

It is, therefore, an important object of the present invention to provide a unique method and apparatus wherein carpet may be lifted or raised without the tedious, time consuming and often damaging pulling, tearing, scraping and the like of the prior art, but wherein a simple method and apparatus enable one to remove carpet by merely placing a tool on the carpet and raising the tool, all of which requires little training or skill, and results in substantial savings in time with considerable reduction or elimination of deleterious effects upon the carpet and supporting floor.

Other objects of the present invention will become apparent upon reading the following specification and referring to the accompanying drawings, which form a material part of this disclosure.

The invention accordingly consists in the features of construction, combinations and arrangements of parts, and method steps, which will be exemplified in the following description, and of which the scope will be indicated by the appended claims.

DESCRIPTION OF THE PREFERRED EMBODIMENT

Figure 1:
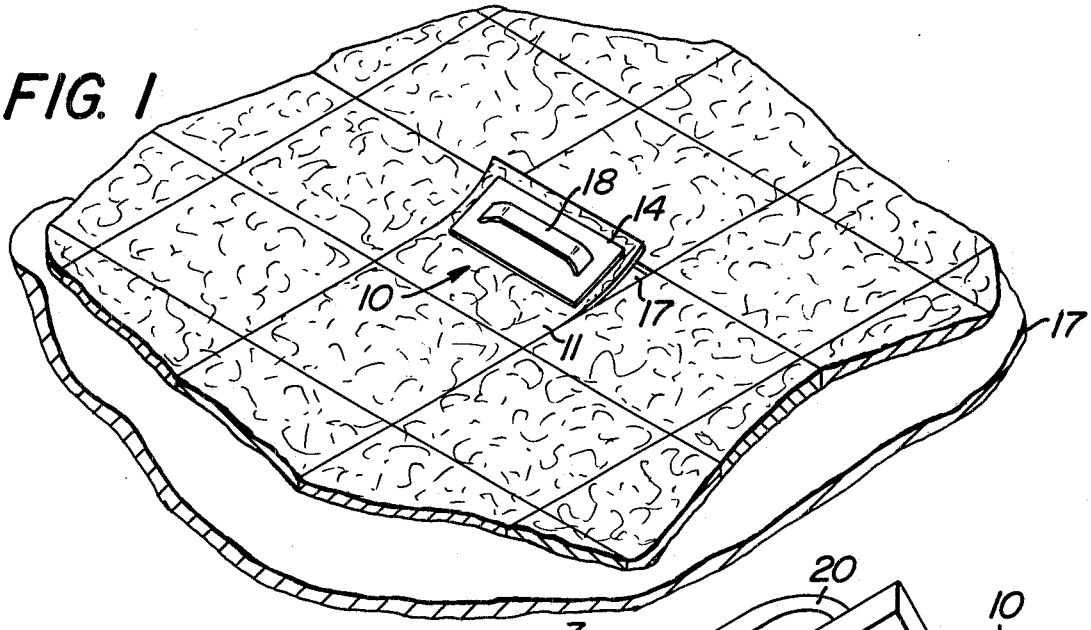
FIG. 1 is a top perspective view showing a carpet lifting tool of the present invention in practice of the instant method.

Referring now more particularly to the drawings, and specifically to FIG. 1 thereof, a carpet lifting tool of the present invention is there generally designated 10, and is shown in operative association with a carpet square of tile 11 laid upon an undersurface or supporting floor 17.

Figure 2:
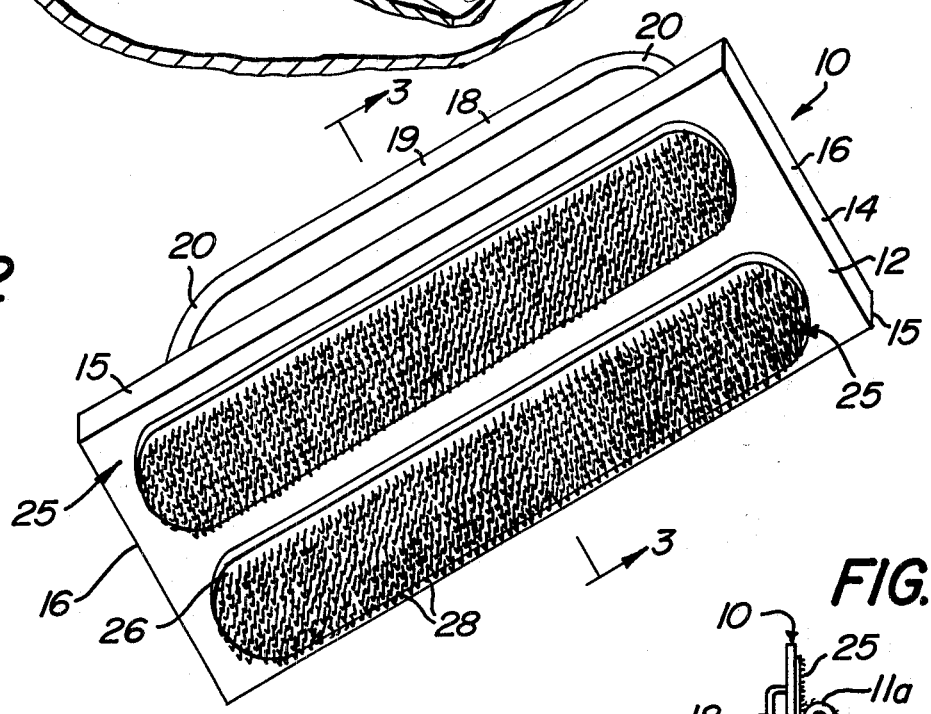
FIG. 2 is a bottom perspective view of the tool of FIG. 1 apart from the carpet.
Figure 3:
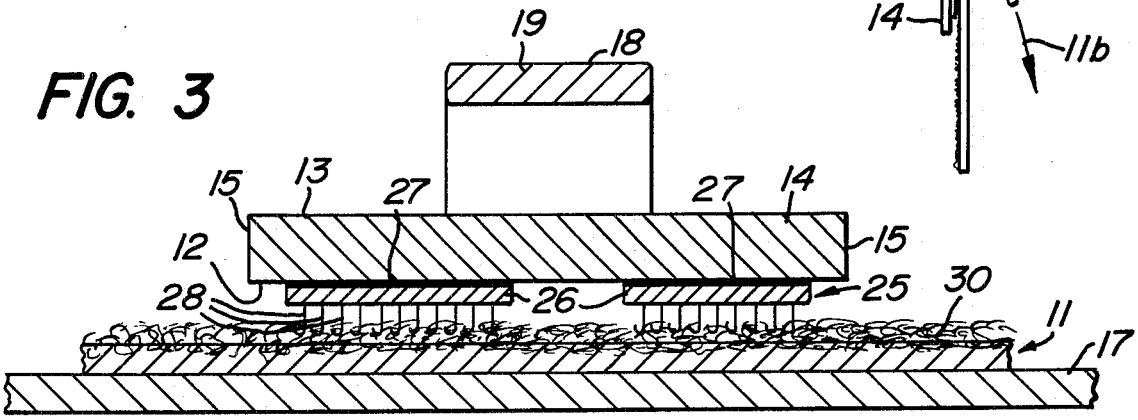
FIG. 3 is a transverse sectional view illustrating the tool in its lifting engagement with carpet.

As best seen in FIGS. 2 and 3, the tool or implement 10 may include a generally flat plate or planar backing member 14 having generally parallel opposed faces 12 and 13, see FIG. 3. The backing member or plate 14 may be generally rigid, say fabricated of wood, metal or plastic, or other suitable material, and may be of an elongate configuration, say generally rectangular as illustrated, or otherwise. In the illustrated embodiment, the backing member or plate 14 may include a pair of generally parallel, longitudinally extending side edges 15, and a pair of generally parallel transversely extending end edges 16, each extending between adjacent ends of the side edges 15.

Provided on one face, say face 13 of backing member or plate 14, may be a hand grip or handle 18. The hand grip or handle 18 may be of any suitable construction, and preferably extends longitudinally of the backing member 14, say including an elongate gripping portion 19 generally parallel to the backing member adjacent to and spaced from face 13. At least one end of the gripping portion 19, as at 20, may extend toward and be rigidly secured to the backing member 14, specifically to the face 13. Of course, the hand grip portion 19 may be provided at its opposite ends with a pair of attachment portions 20, as illustrated.

On the other face 12 of backing member 14, there are provided pieces of fastener fabric, as at 25. More specifically, the fastener fabric 25 may be of the hook and pile type, or other suitable fastener fabric. The hook type of fastener fabric sold under the trademark "Velcro" has been employed and found entirely satisfactory. The area or surface of backing member face 12 may be substantially covered with fastener fabric, and the use of one or more elongate strips has been found entirely satisfactory. For example, each piece 25 of fastener fabric may include a web portion 26 suitably secured in facing engagement with the backing member face 12, as by adhesive 27 or other suitable securing means as desired. Projecting from each web portion 26, away from the backing member 14 are a multitude of relatively stiff fastener elements or hooks 28. The hooks 28 are of a stiff, but flexible filamentous material and are generally of "J" or "U" shaped configuration with their concave sides facing toward the backing member. Thus, the face 12 of backing member 14, remote from handle or hand grip means 18, is substantially covered with the fastener fabric 25, with the fabric hooks 28 extending away from the backing member.

In practice of the instant invention, the tool or implement 10 is laid on a carpet, such as the carpet tile 11 with the handle 18 upwardly, so that the hooks 26 of fastener fabric 25 interengage with the pile 30 of carpet 11. A satisfactorily adhering interengagement between hooks 28 and pile 30 is usually obtained by mere placement of the tool 10 on the carpet 11. However, additionally adherent interengagement is effected by slight horizontal shifting movement of the tool when on the carpet, in a plane generally parallel to the latter. For example, with the user gripping the handle 18, the parallel shifting may be quickly and easily affected by a slight hand twisting action. This will even more intimately intertwine the hooks 28 and pile 30. However, such additional adherence may not be desirable in all circumstances, as when not required for raising carpet from the floor 17, and when resulting in difficult removal of carpet from the tool. Whether such additional holding engagement is desirable in each particular case can be quickly ascertained by trial and error.

Actually lifting the carpet 11 from the supporting floor 17 is readily affected by merely manually raising the tool or implement 10 with the carpet adherent thereto, as illustrated in FIG. 1. As will be appreciated the multitude of hooks 28 in interengagement with the pile loops 30 of carpet 11 effect adequate holding interengagement to assure raising of the carpet.

Figure 4:
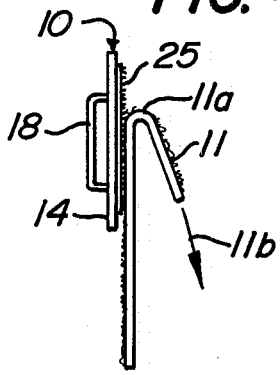
FIG. 4 is an end view showing removal of carpet from the tool in accordance with practice of the instant invention.

In order to remove raised carpet from the tool 10, the carpet may be merely manually stripped from the tool. However, it may be preferable to remove the carpet by flexing, bending or folding the same, as at **11*a* in FIG. 4 and pulling in the direction of arrow 11*b*. This effects a sequential or progressive disconection of hooks 28 from pile 30**, which is, of course, easier than simultaneously disconnecting all of the hooks from the pile.

Of course, the remainder of the carpet or carpet squares may be raised in the same manner as described hereinbefore.

Figure 5:
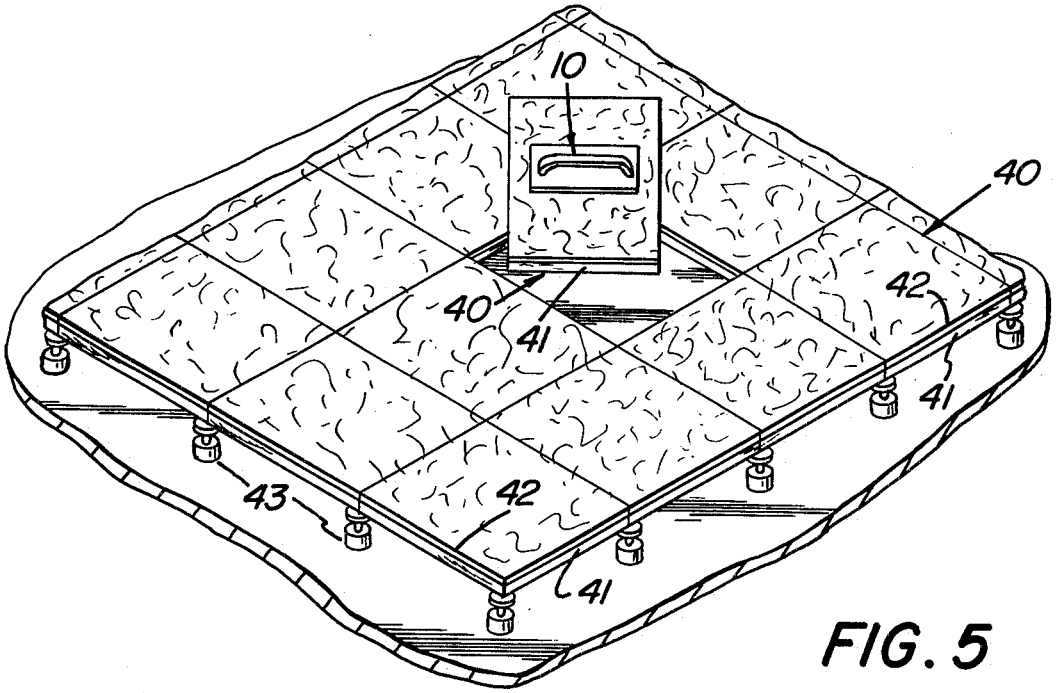
FIG. 5 is a top perspective view similar to FIG. 1 and showing the invention as practised with a raised tile floor construction.

In FIG. 5 there are shown floor tiles 40, say as rectangular plates or boards 41 of wood, metal or the like, each covered or faced on its upper surface with a pile fabric or carpet 42. The carpet or pile fabric 42 is securely fastened to its associated panel or board 41, and the tiles are removably located on upstanding supports or pedestals 43 to provide accessible space beneath the floor tiles 40 for utilities, etc. Selective removal of floor tiles 40 may be accomplished by placing the tool 10 on a tile to interengage the loops of the carpet pile with the hooks of the tool, and raising the tool which will raise the associated floor tile. Actually, floor tiles of about 20 pounds may be raised and removed in this manner without difficulty. Another manner of achieving enhanced adhering engagement between a tool 10 and carpet or floor tile 40 is to impact or pound the tool on the carpet to be removed. Tool removal from a floor tile may be effective by separating one edge of the tool, to effectively swing the tool relative to the floor tile.

It will now, therefore, be appreciated that the present invention provides a method and apparatus for lifting or raising floor tile and carpet from a supporting surface or floor which fully accomplish their intended objects and are well adapted to meet practical commercial conditions.

Although the present invention has been described in some detail by way of illustration and example for purposes of clarity of understanding, it is understood that certain changes and modifications may be made within the spirit of the invention.

What is claimed is:

1. A carpet lifter comprising a generally planar backing member having opposite faces, a hook type fastener fabric secured on one face of said backing member with the hooks away from said backing member and having their concave sides facing toward the backing member, for releasable holding action of said fabric with a loop type carpet when the backing member is placed on the carpet with said one face downwardly, and hand grip means on the other face and extending generally longitudinally of said backing member for raising the latter generally horizontally with a carpet being held thereby.

2. A carpet lifter according to claim 1, said backing member being generally flat, and said fastener fabric covering a substantial portion of said one face.

3. In a method of raising carpet, the steps which comprise: providing a hook type fastener fabric having hooks of generally 180° angular extent, placing the hook type fastener fabric on a pile carpet in interfitting adherent engagement therewith, and lifting the fabric generally horizontally upwardly to raise together therewith the engaged carpet.

4. The method according to claim 3, further characterized in carrying said fabric on a plate, and elevating the plate generally horizontally when the fabric is in adherent engagement with carpet.

5. The method according to claim 3, further characterized in removing carpet from the fabric by flexing the latter progressively away from the fabric.

6. The method according to claim 3, further characterized in shifting the fabric in general parallelism with the carpet subsequent to placement on the carpet for enhanced adhering engagement.

* * * * *